United States Patent [19]

Oda

[11] 4,438,550

[45] Mar. 27, 1984

[54] LOCKABLE SLIDER FOR SLIDE FASTENERS

[75] Inventor: Kiyoshi Oda, Namerikawa, Japan

[73] Assignee: Yoshida Kogyo K. K., Tokyo, Japan

[21] Appl. No.: 356,232

[22] Filed: Mar. 8, 1982

[30] Foreign Application Priority Data

Mar. 16, 1981 [JP] Japan ..... 56-35304[U]

[51] Int. Cl.[3] ..... E05B 67/38

[52] U.S. Cl. ..... 70/57; 70/68; 24/418

[58] Field of Search ..... 24/205.14 R, 205.14 A, 24/205.14 K, 221 K; 70/68, 57

[56] References Cited

U.S. PATENT DOCUMENTS

| | | | |
|---|---|---|---|
| 2,599,207 | 6/1952 | Spahr et al. | 24/221 K |
| 3,270,535 | 9/1966 | Fukuroi | 70/68 |
| 4,015,457 | 4/1977 | Fukuroi | 70/68 |
| 4,221,027 | 9/1980 | Oda | 24/205.14 R |
| 4,262,502 | 4/1981 | Oda | 70/68 |

FOREIGN PATENT DOCUMENTS

| | | | |
|---|---|---|---|
| 1211833 | 3/1966 | Fed. Rep. of Germany | 24/205.14 R |

*Primary Examiner*—Gene Mancene

*Assistant Examiner*—Kris R. Schulze

*Attorney, Agent, or Firm*—Hill, Van Santen, Steadman & Simpson

[57] ABSTRACT

A lockable slider includes a cylindrical plug rotatably mounted in a slider body and a locking member urged at its fore end by a spring member against a cam face of the cylindrical plug for pivotal movement about the one end in response to the rotation of the cylindrical plug, whereby a locking pawl disposed at the rear end of the locking member is brought into and out of locking engagement with a pair of coupling element rows of a slide fastener. The cam face includes a recessed central portion in which the fore end of the locking member is received with the slider in locked position, and a flat peripheral portion over which the fore end of the locking member lying across the recessed central portion is disposed with the slider in unlocked position. The cam face allows the cylindrical plug to be rotated bidirectionally for either locking or unlocking the slider. The cylindrical plug, being slightly movable axially, has on its upper surface a projection, and a cover which overlies the plug has a pair of angularly spaced openings each adapted to slidedly receive and lock the projection for preventing the plug from rotating accidentally in the slider body while the slider is at the locked or the unlocked position.

6 Claims, 10 Drawing Figures

LOCKABLE SLIDER FOR SLIDE FASTENERS

BACKGROUND OF THE INVENTION

1. Field of the Invention

The present invention relates to a slide fastener, and more particularly to a lockable slider for slide fastener.

2. Prior Art

There has been proposed a lockable slider of the type described which includes a built-in locking mechanism comprising a cylindrical plug rotatably received in a cylindrical bore in a slider body and adapted to be rotated by a separate key, a locking member having one end held in engagement with a slanted cam face formed on the lower surface of the cylindrical plug and the other end bent downwardly to provide a locking pawl, and a compression coil spring urging the one end of the locking member and the cylindrical plug upwardly so that the locking pawl is brought into locking engagement with a pair of coupling element rows in response to the rotation of the cylindrical plug. The cylindrical plug has a depending shaft adapted to extend through an aperture in the one end of the locking member into a cylindrical opening in the coil spring. With this arrangement, the locking mechanism must be assembled before it is mounted in the slider body with the result that automated assembling is difficult to achieve. The cylindrical bore has a stopper projecting inwardly from the inner peripheral surface for being slidably received within a peripheral recess formed in the cylindrical plug, the opposite ends of the recess confining the degree of rotation of the cylindrical plug. The assembling of the locking mechanism in the slider body involves the delicate and carefull operation of inserting the cylindrical plug into the bore with the requirement of positioning the cylindrical plug in an accurate angular position relative to the bore. It has accordingly been highly difficult to automate the assembling of the complete slider. Furthermore, the stopper allows the cylindrical plug to rotate in only one direction for locking or unlocking the slider to the pair of coupling element rows so that an operator needs to be careful not to turn the cylindrical plug in the wrong direction, or else either the key or the locking mechanism would be damaged or sometimes broken.

SUMMARY OF THE INVENTION

According to the present invention, a lockable slider comprises a cylindrical plug rotatably received in a forward bore in a slider body and having at the inner end a cam face including a recessed central portion and a flat peripheral portion surrounding said central portion. A locking member has the fore end held beneath the cylindrical plug for sliding movement along the cam face and, at the other end, a locking pawl. A spring member is disposed, within the forward bore, immediately under the fore end of the locking member and urges the fore end of the locking member and the cylindrical plug upwardly. By the turn of a separate key which is inserted into a key recess in the cylindrical plug, the fore end of the locking member is shiftable with the aid of or against the bias of the spring member between an elevated position in which the fore end of the locking member reaches the bottom of the recessed central portion of the cam face and a depressed position in which the former lies on the flat peripheral portion of the latter across the recessed central portion. The locking member thereby pivots about the fore end thereof in such a manner, at the elevated position, to project the locking pawl into a guide channel in the slider body into locking engagement with a pair of coupling element rows and, at the depressed position, to retract the locking pawl from the guide channel into a rearward recess in the slider body. The lockable slider further includes means for preventing said cylindrical plug from moving accidentally within said forward bore.

It is an object of the present invention to provide a lockable slider which is simple in structure and assemblable through a simple and time-saving procedure which easily lends itself to automation.

Another object of the present invention is to provide a lockable slider, of which a locking mechanism can be actuated to the locking position very smoothly irrespective of the position of the slider relative to a pair of coupling element rows.

A further object of the present invention is to provide a lockable slider in which a cylindrical plug is rotatable in opposite directions for locking the slider to or unlocking the slider from a pair of coupling element rows.

Many other advantages, features and additional objects of the present invention will become manifest to those versed in the art upon making reference to the detailed description and the accompanying drawings in which two preferred embodiments incorporating the principles of the present invention are shown by way of illustrative example.

DETAILED DESCRIPTION

Figure 1:
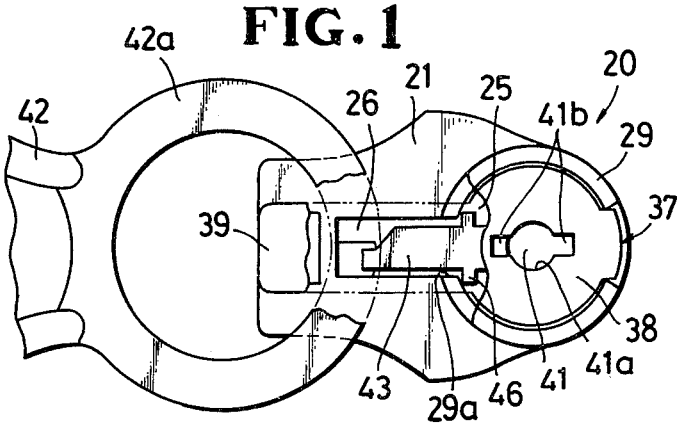
FIG. 1 is a plan view of a lockable slider embodying the present invention the slider being partially broken away for exposure of the interior.
Figure 2:
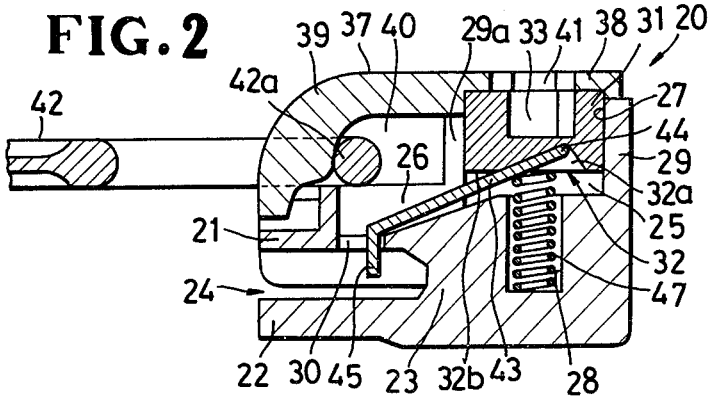
FIG. 2 is a longitudinal cross-sectional view of the lockable slider shown in FIG. 1 with the parts in locking position.
Figure 3:
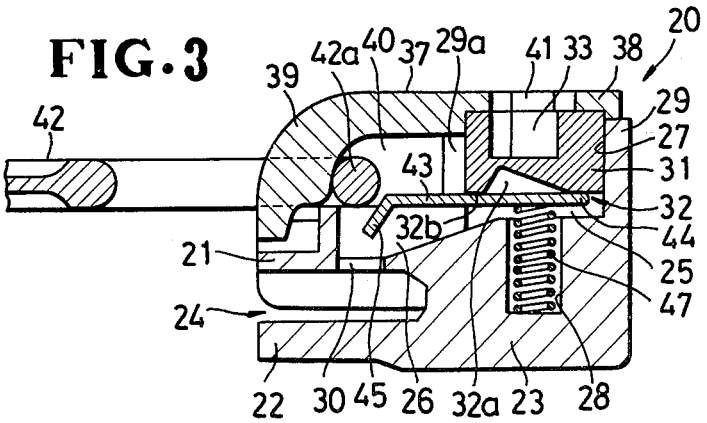
FIG. 3 is a view similar to FIG. 2, but with the parts in unlocking position.

The principles of the present invention are particularly useful when embodied in a key-lockable slider for slide fasteners such as shown in FIGS. 1–3, generally indicated by the numeral 20.

The key-lockable slider 20 comprises a slider body including a pair of upper and lower flanged wings 21,22 joined at one end by a neck 23 so as to define therebetween a generally Y-shaped guide channel 24 for the passage of a pair of coupling element rows of a slide fastener (not shown). The slider body has an upwardly opening forward circular bore 25 and an upwardly opening rearward rectangular recess 26 communicating with the forward circular bore 25. As shown in FIGS. 2 and 3, the circular bore 25 comprises a stepped bore including an upper large-diameter portion 27 and a lower smaller-diameter portion 28, the former portion 27 being defined by the inner peripheral wall of a cylindrical socket 29 formed on the upper surface of the upper wing 21, and the latter portion 28 extending longitudinally in the neck 23 in concentric relation to the former 27. The cylindrical socket 29 is interrupted as at 29*a* so that the forward bore 25 and the rearward recess 26 communicate with each other. An aperture 30 is formed at the bottom of the rearward recess 26 in communication with the guide channel 24.

Figure 6:
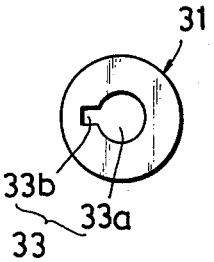
FIG. 6 is a plan view of the cylindrical plug shown in FIG. 5.
Figure 7:
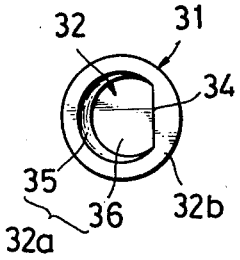
FIG. 7 is a bottom view of the cylindrical plug of FIG. 5.
Figure 5:
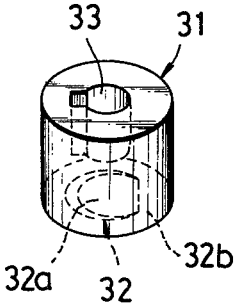
FIG. 5 is a perspective view of a cylindrical plug of the slider.

As shown in FIGS. 2 and 3, a cylindrical plug 31 is rotatably received in the upper large-diameter portion 27 of the stepped forward bore 25. The cylindrical plug 31 has at the inner end a cam face 32 including a recessed central portion 32*a* and a flat peripheral portion 32*b* extending perpendicularly to the central axis of the cylindrical plug 25 in surrounding relation to the recessed central portion 32*a*. A key recess 33 is formed in the upper portion of the cylindrical plug 25 and is adapted to be engaged with an operative tip of a separate key (not shown) for the rotation of the cylindrical plug 25 thereby. As best shown in FIG. 7, the recessed inner cam face portion 32*a* has a segmental shape, or D shape as viewed from below, formed by removing, as at 34, a small segment from a circle, and it is defined by a conical wall 35 and a slanted flat wall 36 extending obliquely with respect to the central axis of the cylindrical plug 25 and merging at the bottom with the conical wall 35. As best illustrated in FIGS. 5 and 6, the key recess 33 includes a hole 33*a* extending axially concentrically in the cylindrical plug 25 and a slot 33*b* extending axially in the cylindrical plug 25 and opening to the hole 33*a*.

A cover 37, as shown in FIG. 1, is in the shape of a banjo comprising a circular body 38 and an elongated rectangular tail 39 extending radially thereof. The banjo-shaped cover 37 is mounted on the slider body in such a manner that the circular body 38 is laid over and is attached to the upper circular border of the interrupted cylindrical socket 29 for closing the forward bore 25, and the tail 39 extends first rearwardly over the rearward recess 26 along the length of the slider body, is then turned arcuately downwardly and terminates at the rear edge of the upper wing 21 to thereby define with the upper surface of the upper wing 21 a relatively large lateral opening 40. The circular body 38 has a keyhole 41 formed in registry with the key recess 33 in the cylindrical plug 31 for reception of the operative tip of the separate key therethrough into the key recess 33. As best shown in FIG. 1, the keyhole 41 comprises a central circular portion 41*a* and a pair of diametrically opposed grooves 41*b*.

A pull tab 42 partially shown in FIGS. 1 to 3 is in the shape of a substantially rectangular plate and has at its fore end a circular ring 42*a* loosely inserted through the relatively large lateral opening 40 for functioning as a pivot with the cover tail 39.

Figure 4:
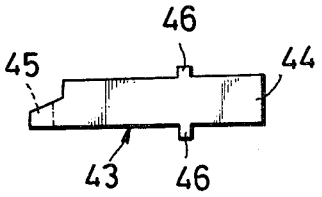
FIG. 4 is a plan view of a locking member of the slider.

A locking member 43 is supported within the forward bore 25 and the rearward recess 26 and extends from the bore 25 to the recess 26 through the interrupted socket portion 29*a*. The locking member 43 has its fore end 44 held beneath the cylindrical plug 31 for sliding movement along the cam face 32 and has its rear end bent downwardly to provide a locking pawl 45 adapted to move into and out of the guide channel 24 through the aperture 30. A pair of lateral branches 46 (FIGS. 1 and 4) is provided on the locking member 43 between the opposite ends 44,45 thereof and extends transversely of the locking member in opposite directions. As shown in FIG. 1, the lateral branches 46 are received in the upper large-diameter portion 27 of the forward bore 25 and are engageable with the inner peripheral wall of the cylindrical socket 29 to prevent the locking member from falling into the guide channel 24.

A compression coil spring 47 is disposed within the small-diameter portion 28 of the forward bore 25 and urges the fore end 44 of the locking member 43 and the cylindrical plug 31 upwardly.

The operation of the slider 20 may begin with the slider 20 held in locked position shown in FIG. 2 in which the fore end 44 of the locking member 43 is held in abutting engagement with the slanted flat wall 36 of the recessed central cam face portion 32*a* of the cylindrical plug 31, and with the locking pawl 45 projecting into the guide channel 24 into locking engagement with the pair of coupling element rows (not shown).

For unlocking the slider 20 from the pair of coupling element rows, the separate key (not shown) is inserted through the keyhole 38 into operative engagement with the key recess 33 of the cylindrical plug 31 and is then turned either in clockwise or in counterclockwise direction, thereby rotating the cylindrical plug 31 within the forward bore 25. As the cylindrical plug 31 is rotated, the fore end 44 of the locking member 43 slides progressively downwardly against the bias of the compression spring 47 by engagement with the straight edge 34 of the cam face 33. When the cylindrical plug 31 is rotated 180 degrees, the fore end 44 of the locking member 43 lies flatwise on the flat peripheral cam face portion 32*b* across the recessed inner cam face portion 32*a*. As a result, the locking member 43 as a whole pivots about the fore end 44 thereof to assume the position shown in FIG. 3 in which the locking pawl 45 is fully retracted from the guide channel 24 into the rearward recess 26, thereby unlocking the slider 20 from the pair of coupling element rows. For locking the slider 20 to the pair of coupling element rows, the separate key is turned in either direction, so as to rotate the cylindrical plug 31. The rotation of the cylindrical plug 31 causes the fore end 44 of the locking member 43 to slide progressively downwardly along the conical wall 35 of the cam face 32 with the aid of the bias of the compression spring 47. When the fore end 44 of the locking member 43 reaches the bottom of the recessed central cam face portion 32*a*, the locking member 43 has the position shown in FIG. 2 in which the locking pawl 45 projects through the aperture 30 into the guide channel 24 into locking engagement with the pair of coupling element rows, thereby locking the slider to the pair of coupling element rows.

Figure 8:
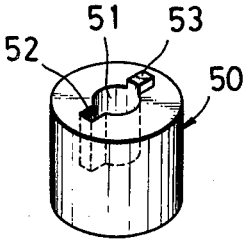
FIG. 8 is a perspective view of a cylindrical member used in another embodiment of the present invention.
Figure 9:
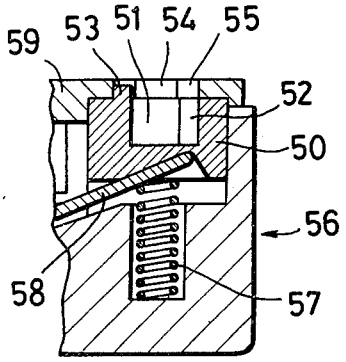
FIG. 9 is a fragmentary longitudinal cross-sectional view of a modified lockable slider including the cylindrical plug of FIG. 8 with the parts in locking position.
Figure 10:
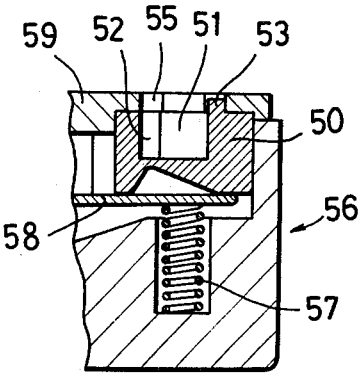
FIG. 10 is a view similar to FIG. 9, but with the parts in unlocking position.

In a second embodiment of the invention shown in FIGS. 8–10, a lockable slider 56 is substantially identical to the slider 20 of the preceding embodiment with the exception of the construction and operation of a cylindrical plug 50. The cylindrical plug 50 has a projection 53 provided on the upper surface thereof in diametrically opposite relation to a vertical slot 52 of a key recess 51 therein. The projection 53 has a shape complementary in contour with that of a pair of diametrically opposed groove portions 55 of a keyhole 54 formed in a cover 59 so that one of the groove portions 55 can receive the projection 53 lockingly therein when the locking lever 58 is brought into either locking (FIG. 9) or unlocking position (FIG. 10). In operation, the separate key (not shown) is inserted through the keyhole 54 into the key recess 51, then lowered against the bias of a compression coil spring 57 to retract and release the projection 53 from one groove 55, and is rotated either in clockwise or in counterclockwise direction to bring the locking member 58 from the locking position of FIG. 9 into the unlocking position of FIG. 10 and vice versa. When the cylindrical plug 50 is rotated 180 degrees, the projection 53 is lockingly received in the other groove 55, whereby the cylindrical plug 50 is prevented from rotating accidentally from the fixed position. The groove portions 55 of the keyhole 54 and the projection 53 of the cylindrical plug 50 cooperate with each other in preventing the accidental rotation of the cylindrical plug 50 and in indicating the condition of the lockable slider 56. When a separate key having a pair of diametrically opposed lateral key bits (not shown) is used to operate the cylindrical plug 50, a pair of diametrically opposed openings (not shown) may be provided in the cover 59 at an angle to the groove portions 55, and the projection 53 may be provided at an angular distance from the position shown in FIGS. 8–10.

As will have been understood from the foregoing description, the assembling of the complete slider 20;56 can be completed by successively delivering the compression coil spring 47;57, the locking member 43;58, the cylindrical plug 31;50, the pull tab 42, and the cover 37;59 down onto the slider body and then by fixedly securing the cover 37;59 to the slider body. The slider 20;56 is thus assemblable through an extremely simple procedure which is easy to automate. The cylindrical plug 31;50 thus assembled can be rotated smoothly either in clockwise or in counterclockwise direction for bringing the slider into or out of locking position with respect to the pair of coupling element rows.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A lockable slider for a slide fastener including a pair of coupling element rows to which the lockable slider is adapted to be locked by a separate key, the lockable slider comprising:

(a) a slider body having a Y-shaped guide channel for the passage of the pair of coupling element rows, an upwardly opening forward bore, an upwardly opening rearward recess communicating with said forward bore, and an aperture in said rearward recess in communication with said guide channel;

(b) a cylindrical plug turntable by the separate key and engageable with its outer end, said plug being rotatably received in said forward bore and rotatable for 360° in either direction from any starting position, and having at the inner end a cam face including a recessed central portion and a continuous flat peripheral portion of constant height surrounding said central portion;

(c) a cover mounted on said slider body and enclosing said forward bore, said cover having a keyhole in registry with said forward bore;

(d) a pull tab pivotably connected to said cover;

(e) a locking member supported within said forward bore and said rearward recess and having the fore end held beneath said cylindrical plug for sliding movement along said cam face, and being movable into and out of said recessed central portion in response to rotation of said cylindrical plug in either direction, and having at the rear end, a locking pawl movable into and out of said guide channel through said aperture for engagement between coupling elements; and (f) a spring member within said forward bore immediately under the fore end of said locking member and urging the fore end of said locking member against said cylindrical plug so that the fore end of said locking member is held by said spring member against diametrically opposite portions of said flat continuous portion to hold said pawl retracted, and is held by said spring member against the bottom of said recessed central portion to hold said pawl in an extended position.

2. A lockable slider according to claim 1, including means on said plug and on said cover for preventing said cylindrical plug from rotating in either direction within said bore.

3. A lockable slider according to claim 2, said preventing means comprising an eccentric axial projection on the upper surface of said cylindrical plug, and a pair of angularly spaced radial openings in said cover and each adapted to alternatively receive said projection and to comprise part of said keyhold.

4. A lockable slider according to claim 1, said upperwardly opening forward bore comprising a stepped bore including an upper large-diameter portion being free of any radial projection into said portion, and a lower small-diameter portion, said cylindrical plug being received in said upper large-diameter portion, and said spring member being nested in said lower small-diameter portion.

5. A lockable slider according to claim 1, said recessed central portion of said cam face having a D-shape and being defined jointly by a conical wall and a slanted flat wall extending obliquely to the axis of said cylindrical plug and merging at the bottom with said conical wall.

6. A lockable slider according to claim 5, the fore end of said locking member being held in abutting engagement with said slanted flat wall of said recessed central portion of said cam face while said pawl is extended.

* * * * *